US005453754A

United States Patent [19]

Fray

[11] Patent Number: 5,453,754

[45] Date of Patent: Sep. 26, 1995

[54] DIELECTRIC RESONATOR ANTENNA WITH WIDE BANDWIDTH

[75] Inventor: Adrian F. Fray, Worcester, United Kingdom

[73] Assignee: The Secretary of State for Defence in Her Brittanic Majesty's Government of the United Kingdom of Great Britain and Northern Ireland, London, England

[21] Appl. No.: 117,676

[22] Filed: Sep. 8, 1993

[30] Foreign Application Priority Data

Jul. 2, 1992 [GB] United Kingdom ..... 9214151
Sep. 11, 1992 [GB] United Kingdom ..... 9219226

[51] Int. Cl.[6] ..... H01Q 1/40

[52] U.S. Cl. ..... 343/789; 343/700 MS; 343/873

[58] Field of Search ..... 343/700 MS, 789, 343/785, 873; H01Q 1/38, 1/40, 13/00, 13/10

[56] References Cited

U.S. PATENT DOCUMENTS 4,197,544 4/1980 Kaloi ..... 343/700 MS
4,772,890 9/1988 Bowen et al. ..... 343/700 MS

FOREIGN PATENT DOCUMENTS 2248522 4/1992 United Kingdom .

OTHER PUBLICATIONS

Long et al.; "The Resonant Cylindrical Dielectric Cavity Antenna"; IEEE Transactions on Antennas and Propagation, vol. AP-31, No. 3, May 1983; pp. 406–412.

Martin et al.; "Dielectric Resonator Antenna Using Aperture Coupling"; Electronic Letters, 22nd Nov. 1990, vol. 26, No. 24, pp. 2015–2016.

Long et al.; "The Input Impedance of the Dielectric Resonator Antenna"; International Journal of Infrared and Millimeter Waves, vol. 7, No. 4, 1986, pp. 555–570.

*Primary Examiner*—Michael C. Wimer
*Attorney, Agent, or Firm*—Nixon & Vanderhye

[57] ABSTRACT

The invention relates to a dielectric resonator antenna system which exhibits an unusually wide bandwidth. This is achieved by chosing a patch antenna/dielectric resonator combination with shape and dimensions such that resonance modes over a continuous range wavelengths can be established therein. The bandwidth and transmission properties of the device are further improved by including a dielectric coupling element (between the dielectric resonator and air) whose antireflection characteristics are optimized for a wavelength which is slightly different from the maximum wavelength of the patch antenna.

9 Claims, 5 Drawing Sheets

DIELECTRIC RESONATOR ANTENNA WITH WIDE BANDWIDTH

BACKGROUND OF THE INVENTION

1. Field of the Invention

This invention relates to a dielectric resonator antenna system with wide bandwidth and, in particular but not exclusively to, such a system for use as an element in a phased array.

2. Discussion of Prior Art

The dielectric resonator antenna is well known. It may be probe fed (e.g. S. A. Long, M. W. McAllistar and L. C. Shen; IEEE Transactions on Antennas and Propagation AP-31, No 3, May 1983, pp406–412 and S. A. Long and M. W. McAllistar; International Journal of Infrared and Millimeter Waves, 7, No4, 1986, pp550–570) where the probe has length approximately equal to one quarter of the operating wavelength, and is used to excite a fundamental mode in a coupling block which takes the form of a dielectric puck. The dimensions of the puck are such that it resonates at a specific frequency, this frequency being determined, to a large extent, by the overall volume of the puck.

Alternatively the coupling block may be excited using a patch antenna formed from microstrip, a form of waveguide comprising a copper strip separated from a groundplane by a dielectric substrate. The copper strip is etched to leave an antenna of the required shape and size, typically a square patch fed at the centre of one edge and with the length of each edge equal to half the operating wavelength. Such antennas have the advantage that they occupy little space and can be conveniently connected to form thin planar arrays.

In an array, each element has its own input and output and by varying the phase of the signal at each element the array can be arranged to transmit or receive in a chosen direction. Moreover the chosen direction can be made time dependant so that a given field can be scanned.

At the interface between the coupling block and air, some of the signal is reflected rather than transmitted. This loss of power can be minimized by including an antireflection layer between the dielectric layer and the air (e.g. British Patent Publication no. GB 2 248 522 A). In order to minimize reflection between two media, the thickness of the antireflection layer should approximate to a quarter wavelength of the signal being transmitted. In addition the material of the antireflection layer should (in theory) have a dielectric constant which approximates to the geometric mean of the dielectric constants of the media on either side. In practice, considerable departure from this ideal is acceptable: for example for matching between air (dielectric constant=1) and a coupling block of material with dielectric constant=10, the ideal matching material would have a dielectric constant of 3.16. In practice it is found that polymethylmethacrylate with a dielectric constant of 2.4 serves adequately as a matching material.

Although the foregoing configurations are relatively simple, their use is limited by the inherently narrow range of frequencies over which they can be operated (ie their inherently narrow bandwidth). For example, H. LI and C. H. CHEN describe a probe fed antenna with bandwidth of approximately 200 MHz at 20 dB in Electronics Letters vol. 26 No. 24 (22 Nov. 1990) pp2015–2016.

SUMMARY OF THE INVENTION

The object of this invention is to provide a dielectric resonator antenna with wide bandwidth.

According to this invention the bandwidth of a dielectric resonator antenna is greatly enhanced by an appropriate choice of shape for the exciting patch. Specifically it has been shown that if a patch is chosen whose length varies along its width, then a wide range of resonant frequencies can be stimulated therein. Furthermore it has been shown that by employing an antireflection block whose optimum frequency is close to, but slightly different from, the minimum frequency of the patch (typically 5% less), the bandwidth and transmission properties of the device are further improved.

According to this invention, a dielectric resonating antenna system comprises

- a dielectric substrate sheet having opposing first and second surfaces;
- a patch antenna formed on the first surface, the patch antenna having a length that varies across the width of the patch such that a wide range of resonant frequencies can be stimulated therein;
- a ground plane formed on the second surface;
- means for feeding signals to and, or from the patch antenna and
- a dielectric coupling element adjacent to the first surface whose dielectric constant and dimensions are such that radiation coupling to and from the patch antenna is predominantly through itself.

In a preferred embodiment, the antenna takes the form of a square, corner-fed patch which is formed on microstrip using the same photo-etching techniques that are standard for making other microwave integrated circuits. An additional advantage of this configuration is that it readily lends itself to implementation of orthogonal planes of polarization by including a second means for feeding signals to and, or from the patch. Other shapes of patch antenna may also provide these properties of enhanced bandwidth and facilitation of orthogonal planes of polarization.

The preferred means for feeding signals to and, or from the patch antenna is via a coaxial feed through the groundplane and dielectric substrate.

An additional preferred embodiment includes a dielectric antireflection layer whose dimensions are chosen to provide quarter wavelength antireflection characteristics for an optimum wavelength which is slightly different from the maximum operating wavelength of the patch antenna.

These components may be enclosed in an open-ended metal cavity which constrains the radiating field to that of an aperture rather than a volume. The dimensions of the cavity may be such that a space (air gap) remains between the coupling element and the cavity wall and/or between the dielectric substrate sheet and the cavity wall.

BRIEF DESCRIPTION OF THE FIGURES

Embodiments of the device will now be described, by way of example only, with reference to the accompanying diagrams in which.

DETAILED DISCUSSION OF PREFERRED EMBODIMENTS

Figure 1:
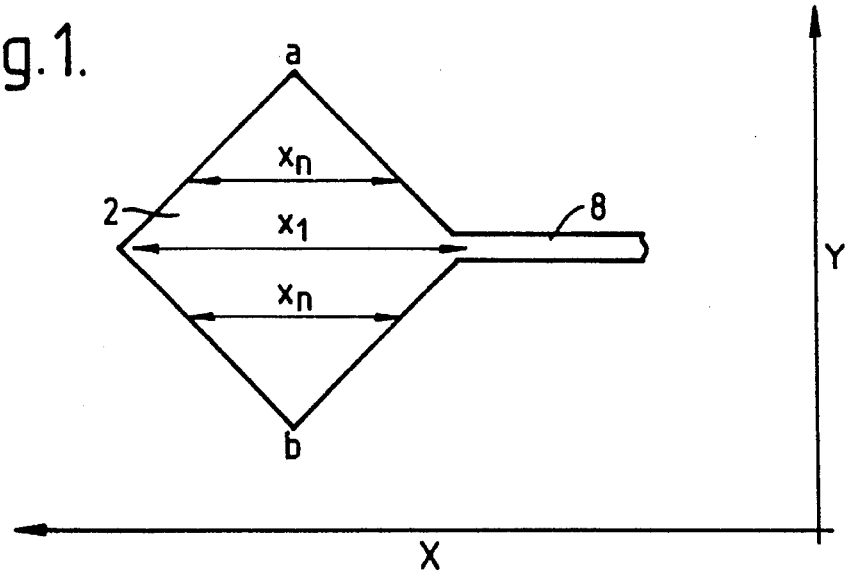
FIG. 1 is an example of the shape of antenna which provides the wide bandwidth properties of the invention.

FIG. 1 shows a square, corner fed patch antenna 2, fed by a planar feed 8. In this orientation, the maximum value of the 'X' dimension of the patch is $x_1$ between opposite corners of the patch. As the line through which this dimension is taken moves in the 'Y' direction away from this starting point, the value of the 'X' dimension decreases through intermediate values $x_n$ to zero at the points a and b. Thus the length of the patch (in the 'X' direction) varies across its width (in the 'Y' direction ).

Figure 2:
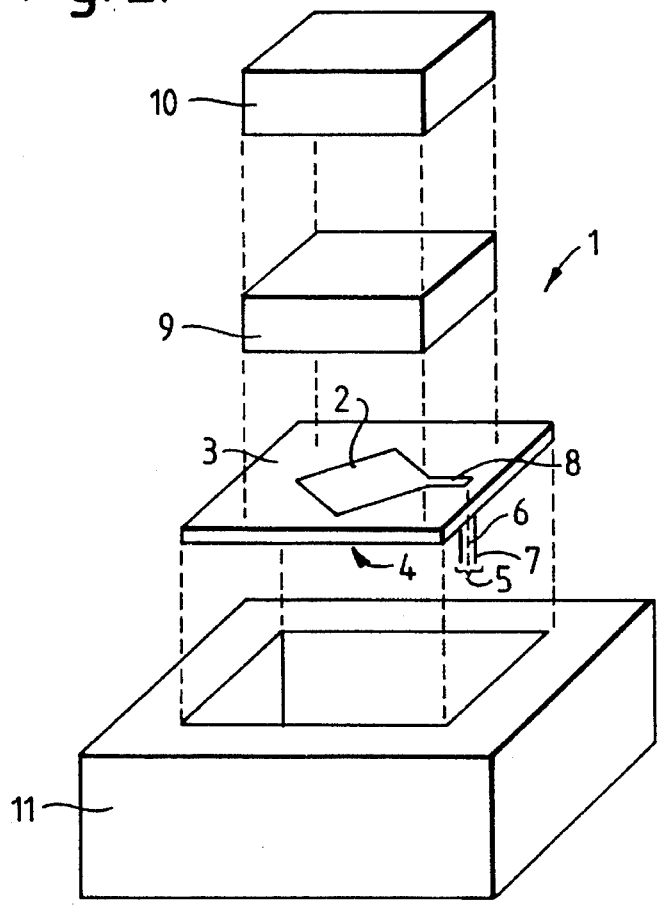
FIG. 2 is an exploded view of a typical antenna system of the invention in disassembled form.

FIG. 2 shows an antenna system 1 of the invention. An antenna of microstrip construction takes the form of a square planar corner-fed patch 2 mounted on a dielectric layer 3. A ground plane 4 clads the underside of the dielectric layer 3. A coaxial radio frequency feedthrough 5 has an inner conductor 6 and an outer shield 7. The inner conductor 6 is insulated from the dielectric layer 3 and is connected to a planar feed 8 into the corner of the patch 2. The outer shield 7 is connected to the ground plane 4.

A dielectric coupling block 9 is located flush against the patch 2 and the top side of the dielectric layer 3. This block 9 is present for radiation purposes and is of PT10, a proprietary material manufactured by Marconi Electronic Devices Ltd., a British company. It is composed of a mixture of alumina and titanium dioxide ceramic materials bound by polystyrene and has a dielectric constant of 10. The thickness of the coupling block approximates to one quarter of the center frequency of the patch and its overall dimensions are chosen to provide optimum resonance at that Frequency.

A second dielectric block 10 is located flush against the top side of the coupling block 9. This second block 10 is present for antireflection purposes and is of polymethylmethacrylate with a dielectric constant of 2.4. It has thickness approximately equal to, but different from, one quarter of the maximum wavelength of the patch.

The dielectric coupling block 9 is bonded to the dielectric layer 3 and the antireflection block 10 using common household glue.

The assembly of the dielectric substrate 3 with ground plane 4 and patch 2, dielectric coupling block 9 and dielectric antireflection block 10, are held within an open-ended metal cavity in the form of casing 11. The particular mode or modes of resonance set up in dielectric coupling block 9 depends on whether the block 9 is in contact with the metal cavity wall or, as shown here and in FIG. 3*d*, there is a gap between the two. It has been found that the best radiation patterns are obtained when a gap of at least 1.5 mm is present all round the block 9. Moreover, if a similar gap (not shown) is present between the substrate 3 and the cavity wall then the interaction between the feed line 8 and the metal surround can be minimized.

Figure 3A:
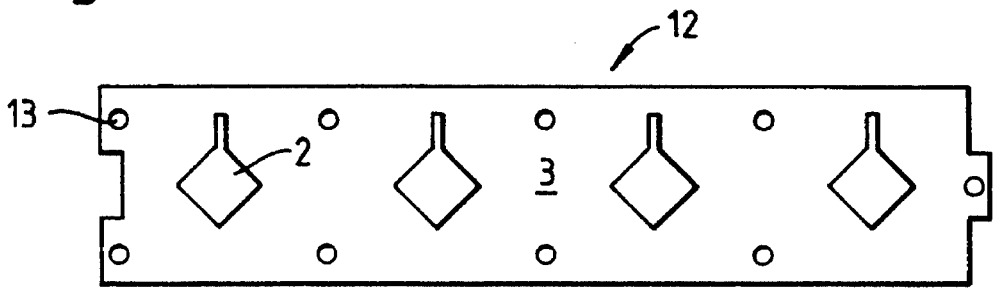
FIGS. 3*a*, 3*b* and 3*c* show the component parts making up a four element sub-array, where each element comprises an antenna system of the invention.

FIG. 3*a* shows a plan view of an array 12 of four square-planar corner-fed patch 2 on a dielectric substrate 3. The underside of the substrate 3 is clad by a copper groundplane (not shown). Holes 13 accommodate retaining screws (not shown).

Figure 3B:
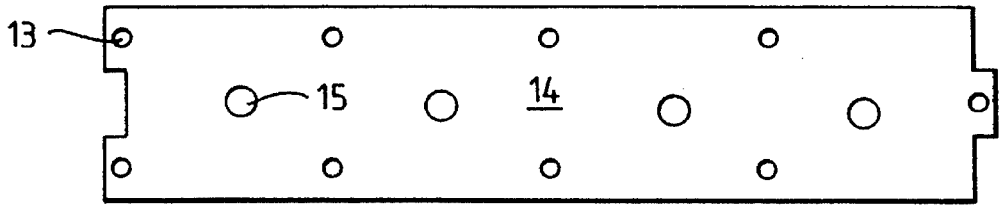

FIG. 3*b* shows a brass backplate 14 which is assembled flush against (and in electrical contact with) the groundplane of the dielectric substrate 3 shown in FIG. 3*a*. Holes 13 are tapped to accommodate retaining screws (not shown). Holes 15 each accommodate a coaxial feedthrough (not shown). The inner conductors of these feedthroughs are insulated from the brass backing plate 14, the dielectric substrate 3 and groundplane, and pass through these to connect with the planar feeds 8 shown in FIG. 3*a*. The outer shields of the coaxial feedthroughs are connected to the brass backing plate 14.

Figure 3C:
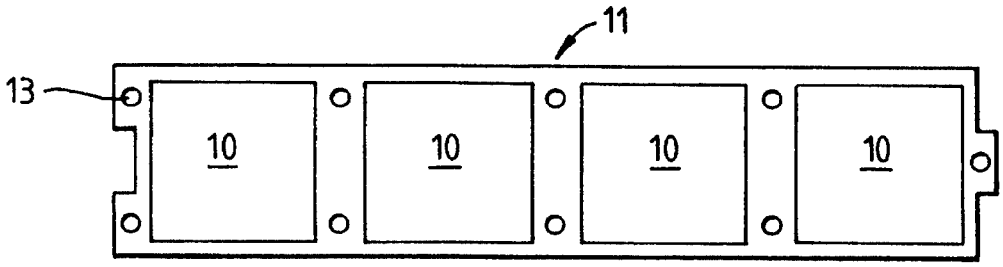

FIG. 3*c* shows an aluminium alloy casing 11 which is mounted on top of the dielectric substrate shown in FIG. 2*a*. Four windows 10 are of transparent polymethylmethacrylate and are present for antireflection purposes. Sandwiched between each window 10 and the corresponding patch 2 on the dielectric substrate 3 is a dielectric coupling block of PT10 material (not shown). The holes 13 accommodate retaining screws (not shown).

Figures 3D, 3E:
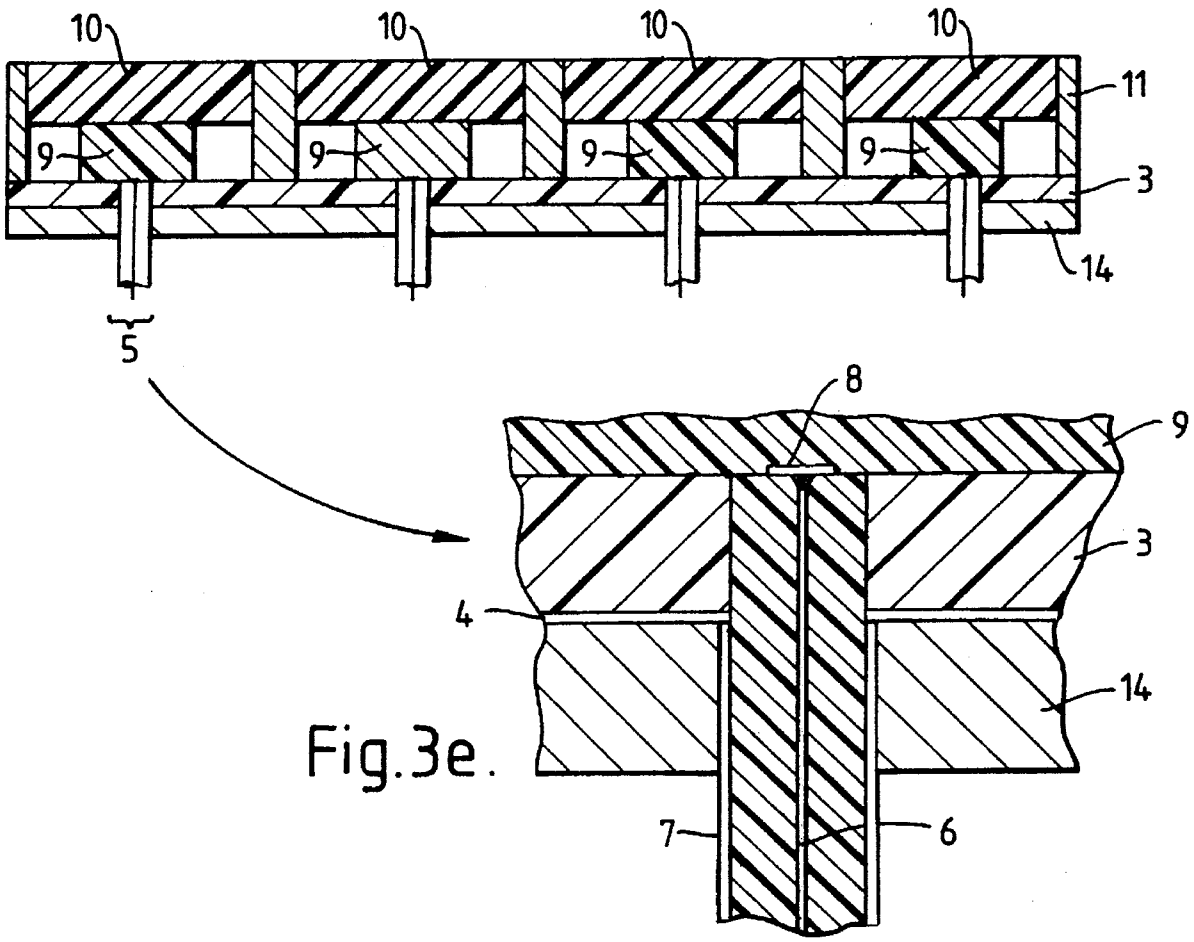
FIG. 3*d* shows a cross-section of the sub-array assembly.
FIG. 3*e* shows an expanded region of FIG. 3*d*. Larger arrays (typically around 2000 elements) are formed by combining a number of sub-arrays such as this.

FIG. 3*d* shows a cross section of an assembly of the components of FIGS. 3*a*, 3*b* and 3*c*. Dielectric coupling blocks 9 and their relationship with the other components are shown. The plane of the section passes through coaxial feedthroughs 5 with inner conductors 6 and outer shields 7. The inner conductors 6 are insulated from, and pass through, the brass backing plate 14 and dielectric substrate 3 and are connected to the planar feeds into the patches (not shown). The outer shields 7 are connected to the brass backing plate 14 only.

Figure 4:
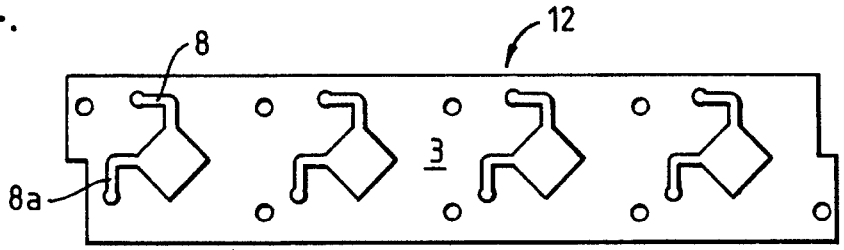
FIG. 4 shows part of an array of patch antennas of the invention with the implementation of orthogonal planes of polarization.

FIG. 4 shows a dielectric substrate 3 with an array 12 of patches similar to that shown in FIG. 2*a* but with the ability to implement orthogonal planes of polarization. This is achieved by including a second planar feed 8*a* on each patch. Planar feeds 8 and 8*a* feed adjacent corners of each patch.

Figure 5:
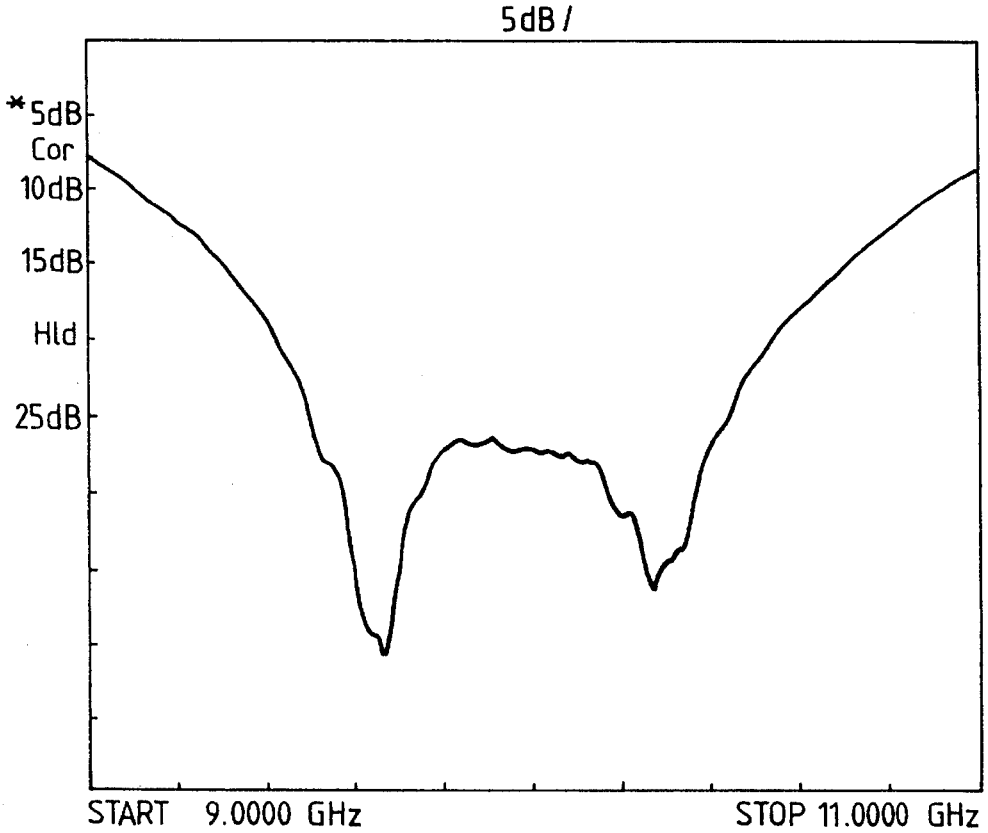
FIG. 5 shows the range of frequencies over which a typical antenna system of the invention was found to be useful.

FIG. 5 is a typical linear plot of the match which can be obtained from the type of antenna system described above. The vertical axis indicates power which is reflected back along the transmission line rather than being transmitted into free space. The diagram shows the variation of this power with signal frequency and a useful bandwidth of about 2 GHz at 20 dB.

Figure 6:
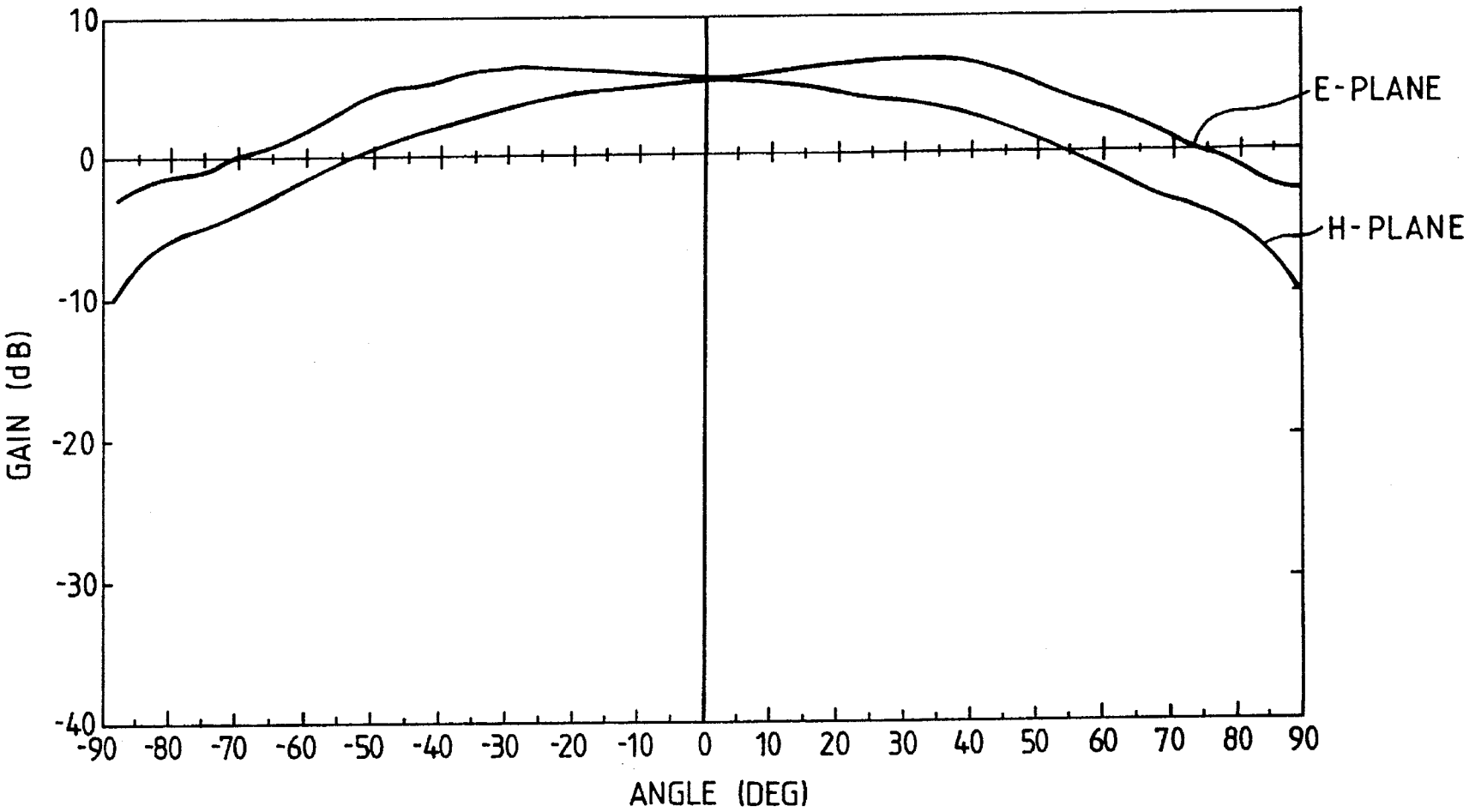
FIG. 6 shows the E-plane and H-plane radiation patterns obtained from a typical antenna system of the invention.

FIG. 6 shows typical E-plane and H-plane radiation patterns obtained from this type of antenna system for a signal frequency of 9.6 GHz.

I claim:

1. A dielectric resonator antenna system comprising:

a dielectric substrate sheet having opposite first and second surfaces;

a patch of electrically conducting material having a center frequency formed on said first surface, the patch having a length that varies across the width of the patch;

a ground plane formed on said second surface;

means for feeding signals to and from the patch; and a dielectric resonating element, adjacent to said first surface and said patch, said resonating element having a dielectric constant, a thickness and a size, wherein said dielectric constant, said thickness and said size of said dielectric resonating element comprises a means for resonating at frequencies including said center frequency, said substrate, patch and resonating element comprising a stack.

2. The dielectric resonator antenna system of claim 1 where the patch is square and fed to and from a corner of said patch.

3. The dielectric resonator antenna system of claim 1 with the addition of a second means for feeding signals to and from the patch.

4. The dielectric resonator antenna system of claim 1 where the means for feeding signals to and from the patch comprises a coaxial cable.

5. The dielectric resonator antenna system of claim 1 further including a dielectric matching element having a thickness different from one quarter of the maximum operating wavelength of the patch.

6. The dielectric resonator antenna system of claim 1 wherein said dielectric substrate sheet, said patch, said ground plane and said means for feeding are enclosed in an open-ended metal cavity having walls.

7. The dielectric resonator antenna system of claim 6 where an air gap is included between the dielectric resonating element and at least one of the cavity walls.

8. An array of antenna systems, each of said systems comprising a dielectric resonator antenna system as claimed in claim 1.

9. The dielectric resonator antenna system of claim 1 wherein said dielectric resonating element has a thickness of approximately one quarter of the wavelength of said center frequency.

* * * * *